US009626946B2

(12) United States Patent
Hilderman et al.

(10) Patent No.: US 9,626,946 B2
(45) **Date of Patent: *Apr. 18, 2017**

(54) VOCAL PROCESSING WITH ACCOMPANIMENT MUSIC INPUT

(71) Applicant: Sing Trix LLC, New York, NY (US)

(72) Inventors: David Kenneth Hilderman, Victoria (CA); John Devecka, Westlake Village, CA (US)

(73) Assignee: Sing Trix LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/237,224

(22) Filed: Aug. 15, 2016

(65) Prior Publication Data

US 2016/0358594 A1 Dec. 8, 2016

Related U.S. Application Data

(63) Continuation of application No. 14/815,707, filed on Jul. 31, 2015, now Pat. No. 9,418,642, which is a (Continued)

(51) Int. Cl.
*G10H 1/38* (2006.01)
*G10H 7/00* (2006.01)
(Continued)

(52) U.S. Cl.
CPC ..... *G10H 1/366* (2013.01); *G10H 1/383* (2013.01); *G10H 2210/066* (2013.01);
(Continued)

(58) Field of Classification Search
CPC .. G10H 1/366; G10H 1/383; G10H 2210/081; G10H 2210/261; G10H 2210/066; G10H 2210/331
(Continued)

(56) References Cited

U.S. PATENT DOCUMENTS 4,184,047 A 1/1980 Langford
4,489,636 A 12/1984 Aoki et al.
(Continued)

OTHER PUBLICATIONS

"VoiceLive 2 User's Manual", Apr. 2009, Ver. 1.3, TC Helicon Vocal Technologies Ltd.
(Continued)

*Primary Examiner* — Jeffrey Donels
(74) *Attorney, Agent, or Firm* — Kolisch Hartwell, P.C.

(57) ABSTRACT

Systems, including methods and apparatus, for generating audio effects based on accompaniment audio produced by live or pre-recorded accompaniment instruments, in combination with melody audio produced by a singer. Audible broadcast of the accompaniment audio may be delayed by a predetermined time, such as the time required to determine chord information contained in the accompaniment signal. As a result, audio effects that require the chord information may be substantially synchronized with the audible broadcast of the accompaniment audio. The present teachings may be especially suitable for use in karaoke systems, to correct and add sound effects to a singer's voice that sings along with a pre-recorded accompaniment track.

20 Claims, 5 Drawing Sheets

Related U.S. Application Data continuation of application No. 14/467,560, filed on Aug. 25, 2014, now Pat. No. 9,123,319, which is a continuation of application No. 14/059,355, filed on Oct. 21, 2013, now Pat. No. 8,847,056.

(60) Provisional application No. 61/716,427, filed on Oct. 19, 2012.

(51) Int. Cl.
*G10H 1/44* (2006.01)
*G10H 1/36* (2006.01)

(52) U.S. Cl.
CPC . *G10H 2210/081* (2013.01); *G10H 2210/261* (2013.01); *G10H 2210/331* (2013.01)

(58) Field of Classification Search
USPC ..... 84/613, 616, 637, 654
See application file for complete search history.

(56) References Cited

U.S. PATENT DOCUMENTS 5,256,832 A 10/1993 Miyake
5,301,259 A 4/1994 Gibson et al.
5,410,098 A 4/1995 Ito
5,469,508 A 11/1995 Vallier
5,518,408 A 5/1996 Kawashima et al.
5,621,182 A 4/1997 Matsumoto
5,641,928 A 6/1997 Tohgi et al.
5,642,470 A 6/1997 Yamamoto et al.
5,703,311 A 12/1997 Ohta
5,712,437 A * 1/1998 Kageyama ..... G10H 1/366 84/610
5,719,346 A 2/1998 Yoshida et al.
5,736,663 A 4/1998 Aoki et al.
5,747,715 A 5/1998 Ohta et al.
5,848,164 A 12/1998 Levine
5,857,171 A * 1/1999 Kageyama ..... G10H 1/366 704/268
5,895,449 A 4/1999 Nakajima et al.
5,902,951 A * 5/1999 Kondo ..... G10H 1/366 434/307 A
5,939,654 A * 8/1999 Anada ..... G09B 15/002 434/307 A
5,966,687 A 10/1999 Ojard
5,973,252 A 10/1999 Hildebrand
6,096,963 A * 8/2000 Hirano ..... G10H 1/186 84/645
6,177,625 B1 1/2001 Ito et al.
6,266,003 B1 7/2001 Hoek
6,307,140 B1 10/2001 Iwamoto
6,336,092 B1 1/2002 Gibson et al.
7,016,841 B2 3/2006 Kenmochi et al.
7,088,835 B1 8/2006 Norris et al.
7,183,479 B2 2/2007 Lu et al.
7,241,947 B2 7/2007 Kobayashi
7,373,209 B2 5/2008 Tagawa et al.
7,582,824 B2 9/2009 Sumita
7,667,126 B2 2/2010 Shi
7,974,838 B1 7/2011 Lukin et al.
8,168,877 B1 * 5/2012 Rutledge ..... G10H 1/38 84/613
8,170,870 B2 * 5/2012 Kemmochi ..... G10H 1/0091 704/207
8,847,056 B2 * 9/2014 Hilderman ..... G10H 1/00 434/307 A
9,123,315 B1 9/2015 Bachand
9,123,319 B2 * 9/2015 Hilderman ..... G10H 1/00
9,159,310 B2 10/2015 Hilderman
9,418,642 B2 * 8/2016 Hilderman ..... G10H 1/38
2003/0009344 A1 1/2003 Kayama et al.
2003/0066414 A1 4/2003 Jameson
2003/0221542 A1 12/2003 Kenmochi et al.
2004/0112203 A1 6/2004 Ueki et al.
2004/0186720 A1 9/2004 Kemmochi
2004/0187673 A1 9/2004 Stevenson
2004/0221710 A1 11/2004 Kitayama
2004/0231499 A1 11/2004 Kobayashi
2006/0185504 A1 8/2006 Kobayashi
2008/0255830 A1 10/2008 Rosec et al.
2008/0289481 A1 11/2008 Vallancourt et al.
2009/0306987 A1 12/2009 Nakano et al.
2011/0144982 A1 6/2011 Salazar et al.
2011/0144983 A1 6/2011 Salazar et al.
2011/0247479 A1 10/2011 Helms et al.
2011/0251842 A1 10/2011 Cook et al.
2012/0089390 A1 4/2012 Yang et al.
2013/0151256 A1 6/2013 Nakano et al.
2014/0039883 A1 2/2014 Yang et al.
2014/0109752 A1 * 4/2014 Hilderman ..... G10H 1/00 84/613
2014/0136207 A1 5/2014 Kayama et al.
2014/0140536 A1 * 5/2014 Serletic, II ..... G06F 3/0481 381/98
2014/0180683 A1 6/2014 Lupini et al.
2014/0189354 A1 7/2014 Zhou et al.
2014/0244262 A1 8/2014 Hisaminato
2014/0251115 A1 9/2014 Yamauchi
2014/0260909 A1 9/2014 Matusiak
2014/0278433 A1 9/2014 Iriyama
2015/0025892 A1 1/2015 Lee et al.
2015/0040743 A1 2/2015 Tachibana

OTHER PUBLICATIONS

VoiceLive 2 Extreme, software version 1.5.01, Apr. 2009, (obtained Jul. 11, 2013 at www.tc-helicon.com/products/voicelive-2-extreme/), TC Helicon Vocal Technologies Ltd.
"VoiceTone T1 User's Manual", Oct. 2010, TC Helicon Vocal Technologies Ltd.
VoiceTone T1 Adaptive Tone & Dynamics, Oct. 2010, (obtained Jul. 11, 2013 at www.tc-helicon.com/products/voicetone-t1/), TC Helicon Vocal Technologies Ltd.
VoiceLive Play, Jan. 2012, (obtained Jul. 11, 2013 at www.tc-helicon.com/products/voicelive-play/), TC Helicon Vocal Technologies Ltd.
"VoiceLive Play User's Manual", Jan. 2012, Ver. 2.1, TC Helicon Vocal Technologies Ltd.
"VoiceTone Mic Mechanic User's Manual" May 2012, TC Helicon Vocal Technologies Ltd.
Mic Mechanic, May 2012, (obtained Jul. 11, 2013 at www.tc-helicon.com/products/mic-mechanic), TC Helicon Vocal Technologies Ltd.
Harmony Singer, Feb. 2013, (obtained Jul. 11, 2013 at www.tc-helicon.com/products/harmony-singer), TC Helicon Vocal Technologies Ltd.
"Harmony Singer User's Manual", Feb. 2013, TC Helicon Vocal Technologies Ltd.
"Nessie: Adaptive USB Microphone for Fearless Recording", Jun. 2013, TC Helicon Vocal Technologies Ltd.
Mar. 5, 2015, First action Interview Pilot Program Pre-Interview Communication from the U.S Patent and Trademark Office, in U.S. Appl. No. 14/059,116, which shares the same priority as this U.S. application.
Apr. 2, 2015, Office action from the U.S. Patent and Trademark Office, in U.S. Appl. No. 14/467,560, which shares the same priority as this U.S. application.
Jun. 10, 2015, Notice of Allowance from the U.S. Patent and Trademark Office, in U.S. Appl. No. 14/059,116, which shares the same priority as this U.S. application.
Oct. 26, 2015, Office action from the U.S. Patent and Trademark Office, in U.S. Appl. No. 14/849,503, which shares the same priority as this U.S. application.

* cited by examiner

VOCAL PROCESSING WITH ACCOMPANIMENT MUSIC INPUT

CROSS-REFERENCE TO RELATED APPLICATIONS

This application is a continuation of U.S. patent application Ser. No. 14/815,707, filed Jul. 31, 2015, which is a continuation of U.S. patent application Ser. No. 14/467,560, filed Aug. 25, 2014, which is a continuation of U.S. patent application Ser. No. 14/059,355, filed Oct. 21, 2013, which claims priority to U.S. Provisional Patent Application Ser. No. 61/716,427, filed Oct. 19, 2012, all of which are incorporated herein by reference into the present disclosure.

INTRODUCTION

Singers, and more generally musicians of all types, often wish to modify the natural sound of a voice and/or instrument, in order to create a different resulting sound. Many such musical modification effects are known, such as reverberation ("reverb"), delay, pitch correction, scale correction, voice doubling, tone shifting, and harmony generation, among others. Complex technology has been developed to process live accompaniment music to analyze and change musical parameters in order to accomplish effects such as pitch and scale correction, tone shifting and harmony generation in real time.

Harmony generation involves generating musically correct harmony notes to complement one or more notes produced by a singer and/or accompaniment instruments. Examples of harmony generation techniques are described, for example, in U.S. Pat. No. 7,667,126 to Shi and U.S. Pat. No. 8,168,877 to Rutledge et al., each of which are hereby incorporated by reference. The techniques disclosed in these references generally involve transmitting amplified musical signals, including both a melody signal and an accompaniment signal, to a signal processor through signal jacks, analyzing the signals immediately to determine musically correct harmony notes, and then producing the harmony notes and combining them with the original musical signals.

Preexisting live pitch and harmony generation techniques have accuracy limitations for at least two reasons. First, different types of musical input or accompaniment are processed using the same methodology and without distinction. More specifically, because these products and algorithms were primarily designed to be applied with a live music input created by a reasonably experienced musician, they have inherent limitations when applied to pre-recorded accompaniment music and/or when used by an inexperienced musician such as an amateur karaoke singer.

The main goal of known techniques is to achieve near zero latency of the musical accompaniment, pitch correction and harmony generation. This harmony generation and pitch correction controlled by live instrument playing can be musically unstructured, for example, during a practice or creative writing session. Accordingly, existing techniques receive the musical input (live guitar or a prerecorded song) and attempt to analyze the music spectrum of the live guitar for lead note, chord, scale and key data for applying proper vocal harmony and pitch correction notes in real time, then immediately outputting the music accompaniment input source so it can be heard by the performer. This rapid analysis and response is necessary when applying harmony generation to live music, because adding any significant audio latency or delay to a live guitar accompaniment would make playing that guitar and performing very difficult or impossible. In some live techniques, a past lead note or spectral history can be stored and used to attempt to provide more accurate harmony. In any case, the real time or near real time analysis of live accompaniment music can result in undesirable errors when applied to pre-recorded music.

In addition, preexisting vocal processing systems typically receive relatively sonically "clean" harmonic information from a single instrument source, such as a guitar input. Because of the live performance requirement and clean accompaniment signal these algorithms provide immediate and generally unfiltered response to the input. This includes generating harmonies for any multiple quick interval key changes played by the musician. During live performance, practicing, and playing this spectral input can be intentionally musically unusual or unstructured. These vocal processing system algorithms rely on the accurate harmonic information from the musician's guitar or instrument input and generally do not interpret the musical intent of input source accompaniment and performer (e.g., a guitarist strumming chords). Therefore, if a guitar player sequentially strums five different chords in five different keys while singing with harmony voices and pitch correction turned on, the system will respond to that music input because the algorithm was designed not to significantly interpret the intent of the live performer.

Conversely, switching between five different musical keys in a sequence is not typical in pre-recorded commercial songs and music. Unlike live performance and practicing with a guitar input, the majority of pre-recorded music is highly structured, predicable, usually contains a detectable start and end point of the song, and follows certain general song and musical theory, norms, and principles. Accordingly, rapid or sequential key changes in pre-recorded music are likely to be errors that should be ignored for the purpose of generating harmony voices.

Unlike a guitar or other live single instrument input, a pre-recorded accompaniment track is much more difficult to analyze accurately for a vocal processing algorithm compared to a live accompaniment instrument, because a pre-recorded track typically involves multiple instruments, overlapping melodies, noise from percussion (non-harmonic sounds), sound effects and/or various vocals, and in some cases may be provided from a relatively poor quality recording. Unlike live performance and practice based musical accompaniment, pre-recorded songs typically follow very predictable key and scale patterns. For example, only a small percentage of all recorded music changes from its original starting musical key. Therefore, one identified the pitch correction notes of the identified key and scale will likely remain the same during an entire song.

In one aspect of the invention, vocal processing accompaniment music sources which drive the harmony generation and pitch correction, like a prerecorded musical track (e.g., a karaoke song) do not require the standard method of real-time analysis of the accompaniment music. Pre-recorded accompaniment can be delayed and allow for longer spectral analysis and utilize more song based statistical interpretation of that input data.

Utilizing the fastest potential non-interpretive vocal processing algorithms results in a technical limitation whereby the harmony or pitch correction cannot be synchronized precisely with the changing input chords in live music source. Using the fastest total processing and output speed possible, harmony voices can still be approximately 200 ms out of sync with the most recent identified live track audio chord. Using previously known harmony generation techniques, this gives rise to short periods of time after each chord change during which musically incorrect harmony notes are produced.

Accordingly, there is a need to distinguish the vocal processing techniques of live accompaniment music from pre-recorded accompaniment music. By employing the novel act of delaying output of only pre-recorded accompaniment signals and extending the time to analyze the accompaniment on the device or application, several significant improvements in harmony generation and pitch correction algorithms and techniques are possible and realized. These improvements can be used to avoid the significant shortcomings of the previous requirement to produce harmony notes and pitch correction in real time. In addition, there is significant reduction in errors while processing complex pre-recorded song spectral content for the required vocal processing data to drive the vocal processing system.

DETAILED DESCRIPTION

Figure 1:
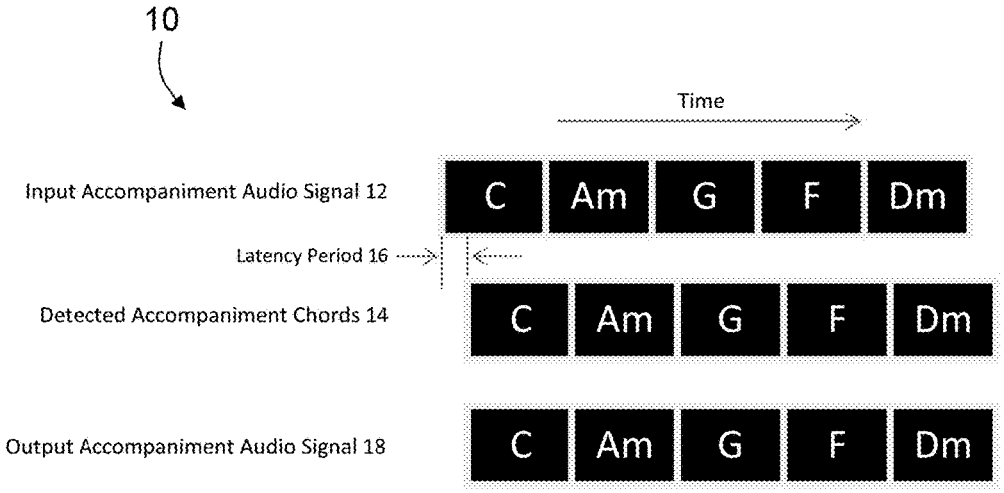
FIG. 1 is a schematic diagram depicting a process for delaying the output of an accompaniment audio signal during an analysis period, according to aspects of the present teachings.

To overcome the issues described above, among others, the present teachings disclose improvements to the existing methods and apparatus for vocal processing live harmony and pitch correction effects. Specifically, the present teachings disclose (1) a new method of pre-recorded accompaniment track analysis, (2) delaying the audible output of a pre-recorded track for at least the time required to accurately synchronize harmony and pitch corrected voices to a spectrally detected chord in an associated pre-recorded accompaniment track, (3) utilizing the sync time buffer or delay or longer to reduce or eliminate harmony generation and pitch correction responses to short detected harmonics that are inconsistent with the playing pre-recorded accompaniment track and recorded track structure, statistics and theories, (4) scanning libraries of songs on a device or service and store the scale and key information associated with each song, (5) using advanced data to further inform the user about the detected key and scale information, and (6) providing the user the detected key(s) and scale(s), confirmation and selection of preferences of the detected key and scale information settings detected by the advanced scanning.

I. DISTINGUISHING LIVE INPUT VS. PRE-RECORDED PROCESSING

According to one aspect of the present teachings, two distinct types of musical inputs are identified separately. Live and pre-recorded accompaniment may be processed in a different manner for purposes of generating more accurate harmony notes and pitch correction. Live performance input, such as a live guitar player's guitar input, will continue to require the current standard of low latency and generally non-interpreted spectral processing response for accompaniment data. That data is typically a single instrument musical input source, such as a guitarist playing a live guitar and singing with live harmony and pitch correction from the device.

According to one aspect of the present teachings, accompaniment music received at a signal processor may not be immediately amplified and played through a loudspeaker, but rather amplification may be delayed for at least the time it takes for the spectral content of the received signal to be analyzed and harmony notes and pitch correction to be generated. As a result, harmony notes may be produced which are essentially now fully synchronized with the amplified accompaniment and melody notes, or pitch corrected notes even after a chord change.

In the new approach, pre-recorded accompaniment music is distinguished from live accompaniment as a different species of musical accompaniment input driving the vocal processing algorithm. Pre-recorded song accompaniment can also be spectrally processed differently for lead notes, chords, keys, and the like by analyzing the music before it is played to the performer whereby any musically inconsistent spectral data based on commercial song structure and other factors can be filtered and potentially rejected producing highly accurate and musically correct pitch and harmony generation data before the audio is audibly played to the user. In other words, buffering or delaying the accompaniment audio (e.g., analyzing the future accompaniment signal and comparing it to the dominant spectral data) provides more accurate harmonization and pitch correction for pre-recorded songs than previous minimally interpretive live methods. In the live accompaniment analysis process, the accuracy detection and processing of the musical source key and scale information will be less accurate because the window of time to analyze and produce a result is very narrow to achieve as close to zero latency as possible for live performance.

In some cases, with a sonically complex multi-instrument recording accompaniment, a momentary incorrect lead note, scale, or chord change can occur as the result of the system incorrectly detecting a momentary sonic combination of instruments and track vocals, noise, fidelity and other variables. That could result in the system changing the entire key of pitch correction and harmony voices to an incorrect key. With the proposed advanced song accompaniment processing method, incorrect brief, repeated and/or sudden detection of lead note, scale or key changes which resolve quickly to the previous or dominate key, note and scale data can potentially be filtered and ignored, whereby the current dominant key, scale or lead note, remains uninterrupted, resulting in significantly fewer unwanted harmonically dissonant system generated tones and harmonies.

In a further extension of the present teachings, scanning up to an entire pre-recorded accompaniment track or library of accompaniment tracks on a device and deriving note, key and scale data may be implemented. The extent and duration of this pre-scanning can have any desired time scale to suit a particular application. For example, it can be short in duration, such as 100-200 milliseconds, or it can be one second, three seconds or much longer, including pre-scanning the entire track to produce a data result. Any amount of advanced track scanning or delay techniques provide the most accurate harmony, pitch correction and time synchronization processing relative to the music accompaniment. Pre-scanning, buffering or delaying a playing track a song track to the performer can allow a larger "future" data segment to determine the most accurate spectral information for pre-recorded song accompaniment, including the omission of frequent brief or lengthy harmonic anomalies found during spectral analyses which are statically inconsistent with standard multi-instrument and vocal songs statistics such as rapid key changes or musically dissonant chord data.

II. AUDIO SIGNAL DELAY FOR PRE-RECORDED ACCOMPANIMENT MUSIC

As mentioned above, determining the current chord or other spectral data in an accompaniment signal takes a signal processor and harmony generator a finite amount of time, typically around 200 milliseconds. In preexisting harmony generation systems used with live music sources, that processing time is a source of inherent lack of synchronization of the generated harmony notes with the original melody and the accompaniment track. While this problem will always be present with live instrument accompaniment such as a guitar input, the present teachings overcome this problem for pre-recorded accompaniment by playing the track and delaying that musical output.

More specifically, harmony voices create a chord with the original melody voice. When chords in the pre-recorded accompaniment music change, the chords created by the melody and harmony voices ideally should change at the same time, rather than at some later time. However, in current live harmony generation systems, the input accompaniment signal is typically amplified immediately, whereas the harmony notes are determined and amplified later and are asynchronous. Therefore, in existing systems, synthesized harmony notes are generally not always synchronized with the detected chords in the original musical accompaniment signal. This can result in a certain discordant sound in the combined amplified output for a finite time after a chord change in the accompaniment audio.

FIG. 1 depicts a process, generally indicated at 10, in which an input accompaniment audio signal 12 is received and analyzed to determine a set of detected accompaniment chords 14, which are then used, possibly in conjunction with input melody notes from a singer's voice, to generate harmony notes. If the input accompaniment audio signal is amplified and output immediately upon being received, the chords produced by the synthesized harmony notes in combination with the originally input audio signal will be musically incorrect during the lag or processing latency period 16 after the input accompaniment chords change but before the detected chords change to the correct value. As described previously, this lag period may be approximately 100-200 milliseconds or after every accompaniment chord change, but can be even longer in some cases.

According to the present teachings, the amplified output accompaniment signal 18, including both the original accompaniment audio and any synthesized harmony notes, may be delayed relative to the input audio signal by a predetermined time, as depicted in FIG. 1. By delaying the accompaniment audio output signal by the time required to detect chords 16 (i.e., the time required to spectrally analyze the accompaniment audio signal) before amplifying the signal and before a singer sings along with it, the resulting vocal harmonies will result in chords that are synchronous with the chords in the accompaniment audio. This new delay time window or longer can further be utilized by the spectral algorithm to reduce inaccurate harmony generation and pitch correction responses to harmonic inconsistencies detected in the complex song spectral content.

Figure 2:
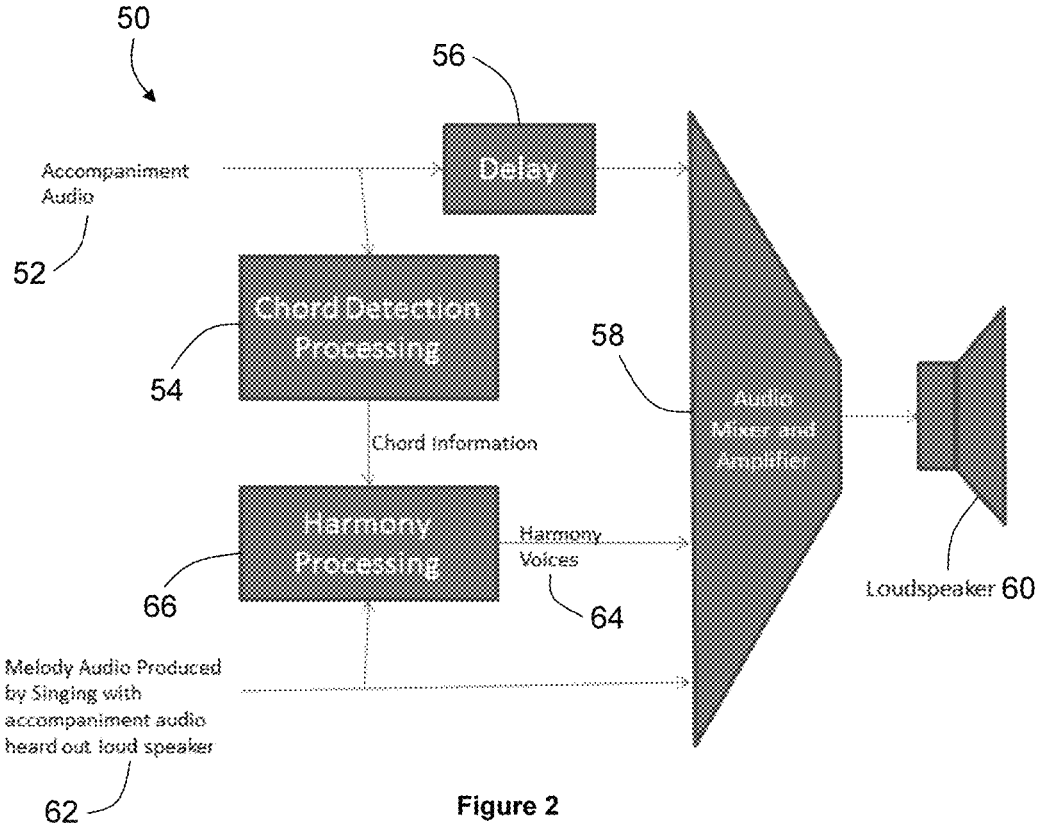
FIG. 2 is a flow diagram illustrating an example of how an accompaniment audio signal may be analyzed during a delay period to produce harmony notes which are substantially synchronized with the audible accompaniment audio output, according to aspects of the present teachings.

The block diagram of FIG. 2 depicts a typical signal flow for a harmony generation system, generally indicated at 50, which more specifically embodies this improvement. The accompaniment audio signal 52 is converted to digital via an analog to digital converter (not shown) in order to allow chord detection by a digital signal processor 54. The delay block 56 works by streaming the digital audio data to memory. The data remains buffered in that memory for a desired delay time before being streamed out to an amplifier 58 and then to a loudspeaker 60. This delay time or buffer may be selected to be equal to the time required to spectrally analyze the accompaniment signal, plus any time required to use that spectral analysis in conjunction with a melody note to create harmony and pitch corrected notes. This buffer amount or captured song segment length can be extended to allow for significant improvement in spectral analysis.

The singer then sings in conjunction with the delayed loudspeaker output, so that the singer's melody signal 62 will be highly synchronized with the latest accompaniment chord that has already been analyzed. The singer's current melody note may be used in conjunction with the analyzed chord to generate harmony notes and/or pitch-corrected melody notes, collectively indicated at 64, with a digital signal processor 66 virtually immediately, resulting in essentially synchronized amplification of the singer's melody note or pitch corrected note, the accompaniment chord or notes, and processor generated harmony notes generated using the present melody and accompaniment data.

In other words, the presently described system provides a sufficient delay or buffer of the pre-recorded accompaniment song so that the singer's output and the accompaniment output is synchronized. The additional buffer window further provides the accompaniment spectral algorithm significantly more time to accurately interpret and process complex multi-instrument music. Although two separate digital signal processors 54 and 66 are shown in FIG. 2, in many cases the spectral analysis and the harmony generation will be performed by a single processor programmed to carry out multiple algorithms.

III. SPECTRAL ANALYSIS TECHNIQUES FOR PRE-RECORDED ACCOMPANIMENT MUSIC

Figure 3:
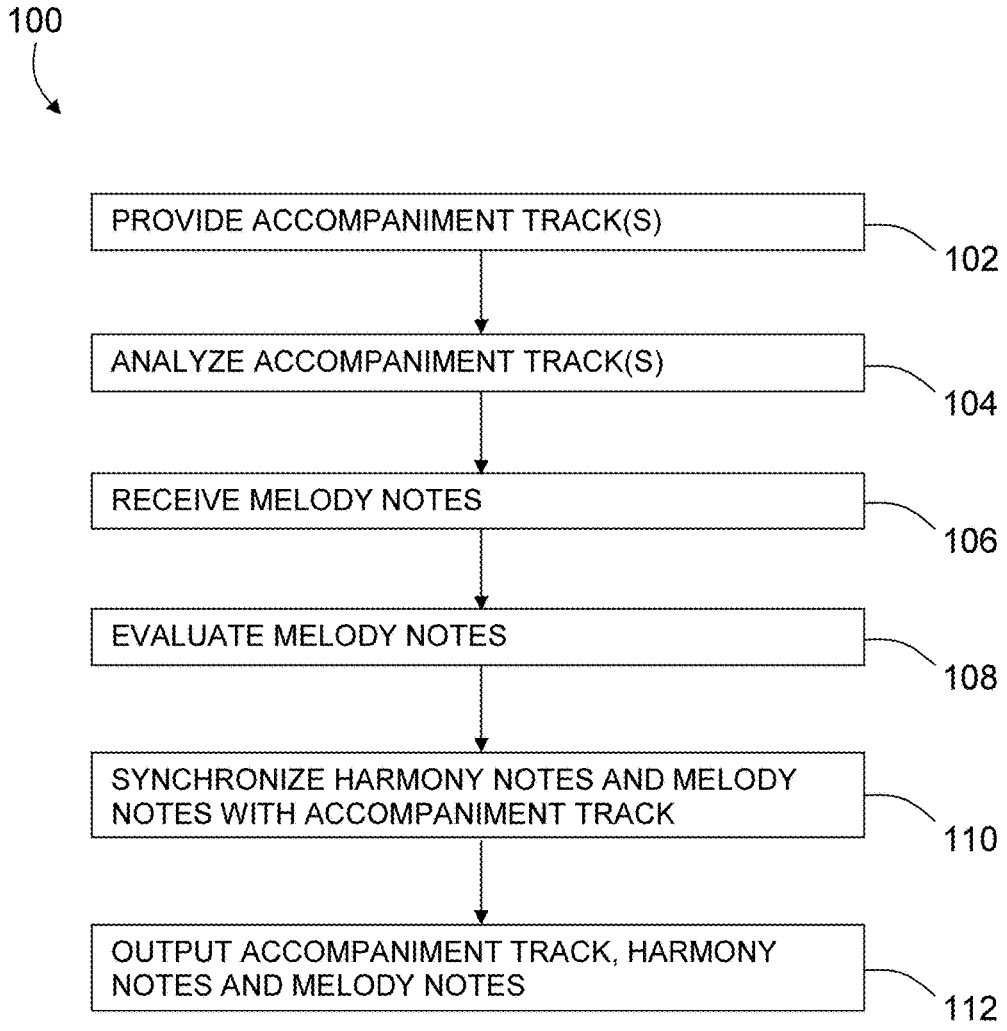
FIG. 3 is a flow chart depicting a method of producing harmony notes which are synchronized with corresponding melody and accompaniment notes, according to aspects of the present teachings.

FIG. 3 depicts the steps of another method, generally indicated at 100, of generating harmony notes and pitch corrected notes according to aspects of the present teachings. As described below, method 100 is particularly applicable to pre-recorded accompaniment music, such as might be used in conjunction with karaoke singing from a large library of songs.

Method 100 allows for a comparatively longer analysis of spectral (i.e., musical note) information, which can even include future accompaniment spectral data and lead notes. Controlling harmony generation and pitch correction with the standard live method using pre-recorded accompaniment of any playable multi-instrument commercial song produces serious inaccuracies because this music source type is the most spectrally complex to analyze accurately in real time. Brief and quickly alternating spectral and harmonic interpretation errors occur due to the complex harmonics of a given music track or for other reasons. These errors are amplified immediately causing incorrect pitch correction and harmony generation. Unlike live performance and live music structure, these events in a pre-recorded song are highly likely to be incorrect data or noise and need to be buffered and filtered for a period of time while the system, for example, maintains the previous and musically correct consistent data. Therefore, in conjunction with the novel delay feature for harmony synchronization, further new methods of controlling and potentially limiting harmony and pitch correction responsiveness are required to greatly improve accuracy. Live instrument methods are insufficient.

This new method combines commercial song structure statistical data such as the fact that commercial songs generally stay in one key from the detected song start point. When most commercial songs change key, the key is maintained for a significant period of time. Incorrect musical spectral interpretation occurs frequently with pre-recorded songs, when inadvertent notes or other types of "noise" are incorrectly interpreted as a key change. The harmony and pitch algorithm in the new method analyzes the future segment of the audible track to omit these errors, relying on the consistency of pre-recorded music structure. Since a novice user can select any possible pre-recorded song in existence to sing along and be the source to control the harmony and pitch correction, the new method directs the pitch correction and harmony notes response to buffer sudden inconsistent accompaniment data following known commercial music standards.

Furthermore, sonically complex prerecorded accompaniment songs can be spectrally analyzed in a manner whereby musically inconsistent sonic analyses data moments (errors) are expected by the control algorithm, and the pitch correction and or harmony generation can be controlled to ignore spectral inconsistencies, maintain the current and future (music scanned in advance) dominant musical features, and ignore these brief errors.

At step 102, an accompaniment track or library of accompaniment tracks is provided. At step 104, a desired accompaniment track or set of provided accompaniment tracks is scanned and analyzed by a signal processor to determine its spectral information. Because there is no urgency to accomplish this in order to synchronize with live playing of accompaniment instruments, time is provided to confirm accurate spectral information and filter potentially erroneous and musically incorrect spectral data. In the case of a detected and potentially erroneous harmonic data point, both pitch correction and harmony generation can be maintained to the previous data point, or only the pitch or scale correction can be maintained to the previous data point while the harmony generation is allowed to follow the potentially erroneous chord data point, balancing the risk that at least one of the two will be musically correct. Moreover, with the additional time that can be spent on spectral analysis, confirming a song key or chord change can be performed accurately and consistently.

At step 106, melody notes are received, typically produced by a karaoke singer's voice, and harmony notes and pitch corrected notes are generated based on the melody notes in conjunction with the recently analyzed accompaniment music. The system maintains output of current key/scale and chord during the buffer period. Also, if a singer is detected as holding a note for a duration of time determined to be a held or sustained note, the algorithm can maintain at least the initial pitch corrected note steady and in some cases the harmony notes can also be maintained, briefly ignoring other conflicting spectral information.

More specifically, according to the present teachings, the performer's held note data may be interpreted by the effects processing algorithm as strongly intending to hold that distinct note, and possibly also to hold the current harmony combination, temporarily overriding any conflict with the key and chord data. The algorithm can resume processing after the held note is released. Rapidly adjusting or pitch correcting a held or sustained note and potentially an associated harmony drastically to another note in the scale or a different key would confuse the performer who obviously intended to maintain those notes and harmonies. Also during this time, additional techniques may be applied to avoid unpleasant harmony or pitch generation, such as by maintaining the output of the current or dominant scale, key and chord data.

At step 108, an evaluation is performed to determine if the current key and scale of the melody notes should be maintained, or if they should be adjusted, and any adjustment is performed. For example, step 108 may include determining if a current melody note is musically complementary with the current accompaniment note, i.e., falls within the same key. In addition, step 108 may include determining if the key of the current accompaniment note is a reliable indication of the accompaniment key, or if it is an anomaly based on a mistake or inadvertent key change in the accompaniment music. This can be accomplished by evaluating the duration of the accompaniment key and ignoring key changes of sufficiently short duration. Because the accompaniment music may be analyzed in advance, evaluating the duration of the accompaniment key can also be done in advance. It need not be done at the instant a particular melody note is sung and detected.

For example, key changes or detected dissonant chord detection anomalies in the accompaniment music of fewer than three seconds, fewer than two seconds, or under any other desired time threshold may be ignored for purposes of performing corrections to the current melody note and or harmony notes. If however, an accompaniment key change is determined to be an actual, intentional key change in the music, then the melody note can be adjusted into the proper key if necessary. Furthermore, if it is determined that the melody note is already in the proper key but is off-pitch (i.e., sharp or flat), the melody note also may be shifted to correct its sound. Pitch shifting of melody notes may be accomplished, for example, using the well known technique of pitch synchronous overlap and add (PSOLA). A description of this technique is found, for instance, in U.S. Patent Application Publication No. 2008/0255830, which is hereby incorporated by reference for all purposes. Additional pitch shifting methods are disclosed, for example, in U.S. Pat. No. 5,973,252, which is also hereby incorporated by reference for all purposes.

At step 110, the generated harmony notes and the melody, including any pitch correction, is synchronized with the accompaniment track. Finally, at step 112, the accompaniment track, the vocal harmonies, and the originally sung melody notes with possible pitch correction and/or other chosen sound effects, all are output, for instance through an output jack or directly from a speaker integrated with a harmony generating karaoke device.

IV. ADDITIONAL EXAMPLES

Figure 4:
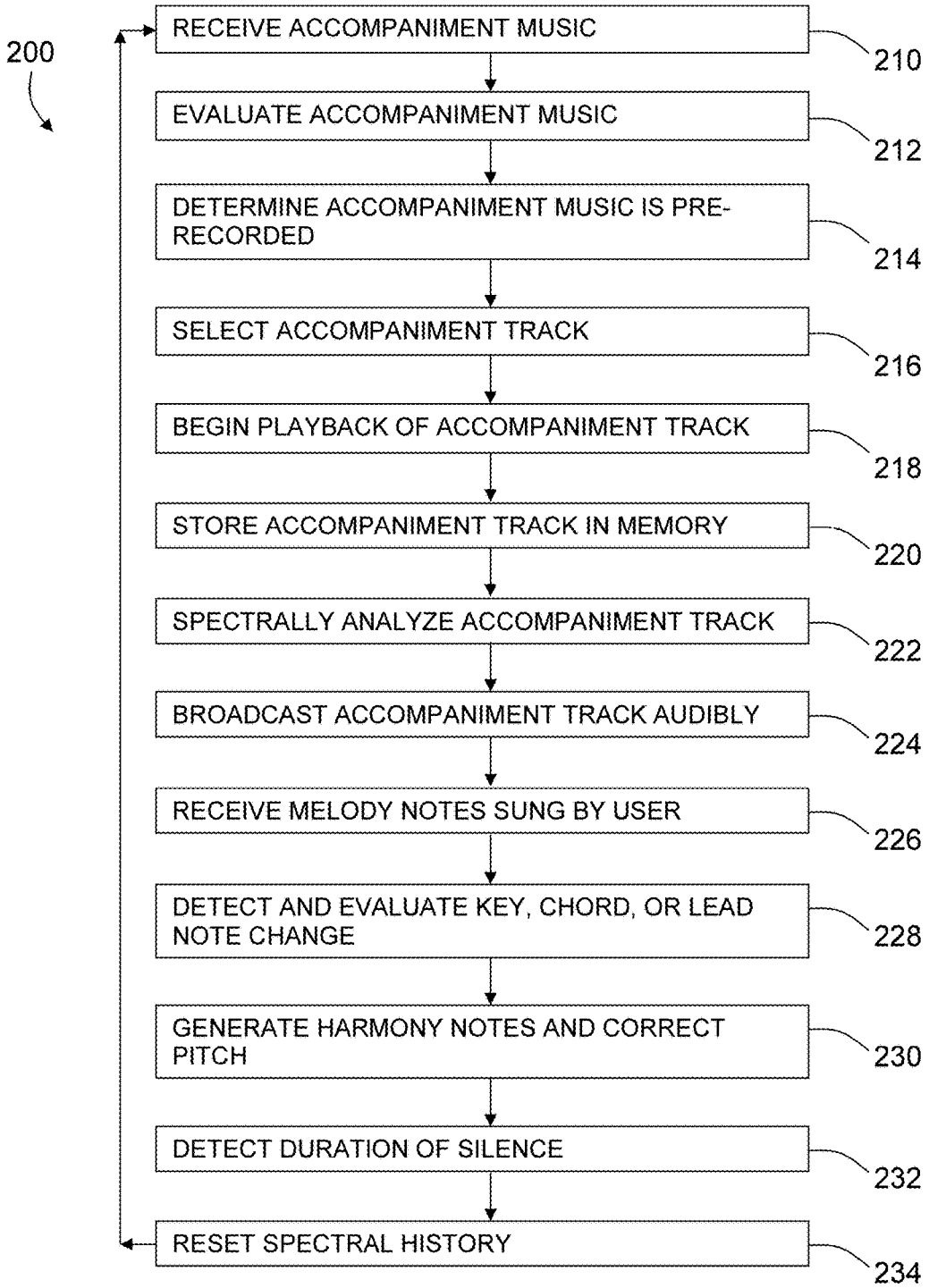
FIG. 4 is a flow chart depicting a method of applying musical effects processing to pre-recorded music, according to aspects of the present teachings.

FIG. 4 depicts a method, generally indicated at 200, of applying musical effects processing to pre-recorded music according to aspects of the present teachings. At step 210, a musical effects processor receives accompaniment music. At step 212, the processor evaluates the accompaniment music to detect the sonic differences of a live guitar input compared to a pre-recorded song, for example by recognizing a drum beat. At step 214, the processor determines that the accompaniment music is pre-recorded, and enters a pre-recorded analysis mode. Alternately, the device may be manually set to a pre-recorded accompaniment mode. When this mode is selected, either automatically or manually, the effects processor may scan an up to an entire selected track or library of tracks prior to the user performing with the accompaniment.

At step 216, the user selects a single accompaniment track for an immediate performance. At step 218, the track accompaniment begins to play but is not audible to the user. Instead, at step 220, a delay buffer stores the track in memory for at least the time required to synchronize the harmony and pitch correction output with the latest detected chord accompaniment, and perhaps longer. During this time, at step 222, the spectral analysis algorithm of the effects processor attempts to determine the current key, scale and chord in the accompaniment song. Special pre-recorded song based filters and algorithms are enabled for this purpose, which are different from live guitar input algorithms. At step 224, the accompaniment is broadcast audibly to the user, for example through a loudspeaker, and at step 226, the processor receives melody notes sung by the user.

At step 228, the processor detects a key, chord, or lead note change in the accompaniment audio and/or in the melody notes, and evaluates the change to determine whether to accept the change for purposes of harmony generation and/or pitch correction. If the duration of the change is less than a predetermined threshold duration, such as three seconds, two seconds, one second, or any other desired threshold, the algorithm ignores the change and maintains the current or dominant key, chord or lead note data. On the other hand, if a change is detected for a consistent duration past the threshold, the algorithm may accept the change for purposes of harmony generation and pitch correction.

At step 230, the processor generates harmony notes and makes any pitch correction deemed necessary. Since the buffered delay of the audible audio is at least the time to spectrally analyze the accompaniment track and generate the harmony notes and pitch corrected notes, the harmony notes and accompaniment chords are synchronized. When the track accompaniment ends, at step 232 a duration of silence can be detected by the spectral algorithm. At step 234, the processor then can potentially reset or remove any previous spectral history. Upon recognition of a starting track from a period of silence, a new spectral history for that song can begin to be stored, returning to step 210 of the method.

Figure 5:
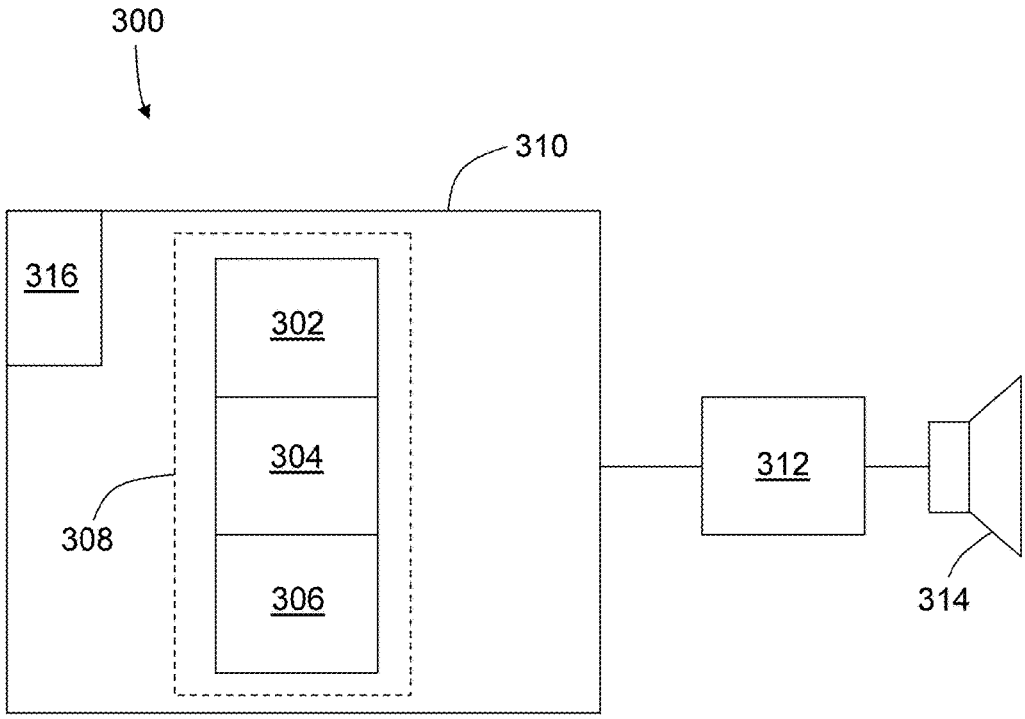
FIG. 5 schematically depicts a system for processing accompaniment music and generating audio effects, according to aspects of the present teachings.

FIG. 5 schematically depicts a system, generally indicated at 300, that may be used to practice aspects of the present teachings. System 300 may be generally described, for example, as a time-aligned audio system for harmony generation, a harmony generating sound system, or a harmony generating audio system.

System 300 includes a chord detection circuit 302, which also may be referred to simply as a chord detector, a harmony processing circuit 304, which may be referred to more generally as a note generator, and a delay circuit 306, which also may be referred to as a delay unit. In some cases, chord detection circuit 302, harmony processing circuit 304 and delay circuit 306 all may be portions of a digital signal processor, as indicated at 308. Furthermore, digital signal processor 308 may be integrated into a karaoke machine 310, along with other components such as an amplifier 312, a loudspeaker 314 and/or a microphone 316.

Chord detection circuit 302 is configured to receive and analyze an accompaniment audio signal, and to determine chord information corresponding to a chord of the accompaniment audio signal. In other words, the chord detector is configured to receive an accompaniment audio signal, to analyze the accompaniment audio signal to determine chords contained within the accompaniment audio signal, and to produce chord information corresponding to the chords that have been determined. This process generally takes a particular duration of time, which is typically on the order of hundreds of milliseconds, such as 200 ms.

Harmony processor circuit or note generator 304 is configured to receive and analyze the chord information produced by the chord detector along with melody notes received from a singer, and to produce a synthesized harmony signal corresponding to each detected chord and melody note. The harmony signal will be harmonized to the chord of the accompaniment audio signal and the melody note, and the harmony processing circuit is typically configured to transmit the harmony signal to a loudspeaker to produce harmony audio.

Delay circuit or unit 306 is configured to receive the accompaniment audio signal, and to store the accompaniment audio signal in memory for a predetermined delay time until the chord detector produces the chord information. The delay circuit is further configured to stream the accompaniment audio signal to the loudspeaker after the predetermined delay time has lapsed to produce accompaniment audio. In some cases, the predetermined delay time approximates the duration of time required for the chord detector to extract chord information from the accompaniment audio signal. In other cases, the delay time may be longer, and may allow for additional analysis of the accompaniment audio.

When system 300 or portions thereof are integrated into a karaoke machine such as machine 310, the accompaniment audio signal will typically be pre-recorded, and the melody notes will be received in real time from a karaoke singer using microphone 316. In this case, system 300 will be configured to generate harmony notes as quickly as possible after receiving each melody note, i.e., the system may be configured to produce the harmony signal substantially in real time with receiving and amplifying the melody note. To accomplish this, the harmony processing circuit may be further configured to transmit the melody note to the loudspeaker, along with the harmony notes and the accompaniment signal. According, system 300 may be configured to broadcast the accompaniment audio signal, the melody audio signal and any generated harmony notes through the loudspeaker substantially simultaneously.

Digital signal processor 308 also may be configured to perform other functions. For example, the digital signal processor may be configured to determine a musical key of the accompaniment audio signal and to create a pitch-corrected melody note by shifting the melody note received from the singer into the musical key of the accompaniment audio signal, and to transmit the pitch-corrected melody note to the loudspeaker. In other words, the digital signal processor (or a portion thereof, such as the note generator) may be configured to determine a pitch of the melody note and to generate a pitch-corrected melody note if the pitch of the melody note is musically inconsistent with the chord information. When pitch-shifted melody notes are generated, they may be broadcast through the loudspeaker in place of the corresponding original melody notes, which have presumably been determined to contain a pitch error. In some cases, however, the system may be configured to amplify and audibly produce both the original melody notes and the pitch-shifted notes, for instance as a method of allowing a karaoke singer to hear the correction.

In some cases, the note generator may be configured to generate a pitch-corrected melody note only based on chord information representing chord changes lasting longer than a predetermined threshold duration. That is, the note generator may be configured to ignore short-term chord changes that have a high probability of misrepresenting the overall pattern or intent of the accompaniment music. Similarly, the harmony generator may be configured to ignore such short-term chord changes. Generally speaking, short-term chord changes may be ignored for purposes of generating harmony notes, generating pitch-shifted melody notes, or both.

In addition to possibly ignoring chord changes that occur for less than a predetermined duration, signal processor 308 may be configured to ignore other types of chord information, such as chord information that is determined to represent sounds produced by percussion instruments or by other sources that are unlikely to embody a musician's intent to change chords. As in the case of short-term chord changes, such source specific chord information can be ignored for purposes of generating harmony notes, generating pitch-shifted melody notes, or both.

What is claimed is:

1. A method of generating a musical harmony signal, comprising:

scanning a pre-recorded song stored in digital form on an electronic device;

analyzing the pre-recorded song to determine a musical key of the pre-recorded song;

receiving a melody note from a singer;

generating a harmony signal harmonized to the musical key of the pre-recorded song and the melody note;

transmitting the harmony signal to an output mechanism to produce output harmony audio;

streaming an accompaniment audio signal corresponding to the pre-recorded song to the output mechanism after a predetermined delay time has elapsed to produce accompaniment audio;

wherein determining the musical key of the pre-recorded song requires a first duration of time, and wherein the predetermined delay time is at least equal to the first duration of time.

2. The method of claim 1, wherein the melody note is received in real time from a karaoke singer.

3. The method of claim 1, wherein the harmony signal is produced substantially in real time with receiving the melody note.

4. The method of claim 1, wherein the predetermined delay time approximates the first duration of time.

5. The method of claim 1, further comprising transmitting the melody note to the output mechanism.

6. The method of claim 5, wherein the output mechanism is a loudspeaker.

7. The method of claim 5, wherein the output mechanism is an output jack.

8. The method of claim 1, further comprising:

creating a pitch-corrected melody note by shifting the melody note received from the singer into the musical key of the pre-recorded song; and transmitting the pitch-corrected melody note to the output mechanism.

9. The method of claim 1, wherein the predetermined delay time exceeds the first duration of time by a time required to generate the harmony signal after receiving the melody note.

10. A harmony generating method, comprising:

causing a digital signal processor to:

(i) analyze a pre-recorded song stored in digital form on an electronic device, to determine chord information contained within the pre-recorded song;

(ii) after a time at least equal to the time required to determine the chord information, transmit an accompaniment audio signal corresponding to the pre-recorded song to an audio output mechanism;

(iii) receive a melody audio signal produced by a singer's voice;

(iv) generate at least one harmony note based on the chord information and the melody audio signal; and (v) transmit the melody audio signal and the harmony note to the audio output mechanism.

11. The method of claim 10, wherein the audio output mechanism is a loudspeaker.

12. The method of claim 10, wherein the audio output mechanism is an output jack.

13. The method of claim 10, wherein the accompaniment audio signal, the melody audio signal and the harmony note are transmitted to the audio output mechanism substantially simultaneously.

14. The method of claim 10, wherein generating the harmony note is based on the chord information excluding chord changes of less than a predetermined duration and also excluding chords determined to have been produced by percussion instruments.

15. A method of generating harmonized audio signals with a digital signal processor, comprising:

with a digital signal processor, analyzing a pre-recorded digital song to determine key information associated with the song;

with the digital signal processor, receiving a melody note produced by a singer, and generating a synthesized harmony signal harmonized to the melody note and a corresponding key of the pre-recorded song; and transmitting the pre-recorded song, the melody note and the synthesized harmony signal to an output mechanism to produce synthesized harmony audio, wherein the pre-recorded song, the melody note and the corresponding synthesized harmony audio are synchronized when produced by the output mechanism.

16. The method of claim 15, wherein the key information includes key changes, and wherein the digital signal processor is configured to ignore key changes lasting less than a predetermined threshold duration.

17. The method of claim 15, wherein the output mechanism is a speaker.

18. The method of claim 15, wherein the output mechanism is an output jack.

19. The method of claim 15, further comprising storing the pre-recorded song in memory for at least a time required to generate the synthesized harmony signal.

20. The method of claim 15, further comprising:

creating a pitch-corrected melody note by shifting the melody note received from the singer into the corresponding key of the pre-recorded song; and transmitting the pitch-corrected melody note to the output mechanism.

* * * * *